US010709250B2

(12) United States Patent
Smith et al.

(10) Patent No.: US 10,709,250 B2
(45) Date of Patent: Jul. 14, 2020

(54) HEATED COVER FOR AN ARTICLE OF FURNITURE

(71) Applicants: ReAnna Gayle Smith, Columbia, IL (US); Kyle Matthew Smith, Columbia, IL (US)

(72) Inventors: ReAnna Gayle Smith, Columbia, IL (US); Kyle Matthew Smith, Columbia, IL (US)

( * ) Notice: Subject to any disclaimer, the term of this patent is extended or adjusted under 35 U.S.C. 154(b) by 0 days.

(21) Appl. No.: 14/044,408

(22) Filed: Oct. 2, 2013

(65) Prior Publication Data

US 2015/0090704 A1 Apr. 2, 2015

(51) Int. Cl.

| | |
|---|---|
| ***A47C 7/74*** | (2006.01) |
| ***A47C 4/30*** | (2006.01) |
| ***A47C 4/28*** | (2006.01) |
| ***A47C 31/11*** | (2006.01) |
| ***H05B 3/34*** | (2006.01) |

(52) U.S. Cl.

CPC ..... *A47C 7/748* (2013.01); *A47C 4/286* (2013.01); *A47C 4/30* (2013.01); *A47C 31/11* (2013.01); *H05B 3/34* (2013.01); *H05B 2203/003* (2013.01); *H05B 2203/005* (2013.01); *H05B 2203/029* (2013.01); *Y10T 29/49826* (2015.01)

(58) Field of Classification Search

CPC ..... A47C 7/748; A47C 4/30; A47C 4/286; A47C 31/11; B23P 19/00; H05B 2203/003; H05B 2203/005; H05B 2203/029; Y10T 29/49826

See application file for complete search history.

(56) References Cited

U.S. PATENT DOCUMENTS

| | | | | |
|---|---|---|---|---|
| 2,731,542 A * | 1/1956 | Daniels | H05B 3/34 219/202 |
| 3,472,289 A * | 10/1969 | Riordan | B64D 15/12 139/391 |
| 5,516,189 A * | 5/1996 | Ligeras | A47C 7/748 219/202 |

(Continued)

FOREIGN PATENT DOCUMENTS

| | | |
|---|---|---|
| DE | 202007006790 U1 | 7/2007 |
| GB | 2454477 A | 5/2009 |

OTHER PUBLICATIONS

PCT International Search Report and Written Opinion for related matter PCT/US2014/058892 dated Jan. 7, 2015, 13 pp.

(Continued)

*Primary Examiner* — Shawntina T Fuqua

(74) *Attorney, Agent, or Firm* — Armstrong Teasdale LLP

(57) ABSTRACT

A heated cover for use with an article of furniture comprises an exterior top layer and an exterior bottom layer that are fabricated from a conductive material. The heated cover also includes a plurality of heating pads positioned between the exterior top layer and the exterior bottom layer. Each of the plurality of heating pads comprises a heating element configured to convert electrical energy to thermal energy and a padding layer coupled between the heating element and the exterior bottom layer. The heated cover also includes a rechargeable electrical storage device coupled to the plurality of heating pads. The rechargeable electrical storage device is configured to provide electrical energy to the plurality of heating pads.

19 Claims, 4 Drawing Sheets

(56) References Cited

U.S. PATENT DOCUMENTS

| | | | | |
|---|---|---|---|---|
| 6,792,671 | B1 | 9/2004 | Oberg | |
| 6,814,408 | B2 | 11/2004 | Chen | |
| 7,438,356 | B2 | 10/2008 | Howman et al. | |
| 7,866,743 | B1 | 1/2011 | Russell et al. | |
| 8,123,290 | B1 * | 2/2012 | Aiken | A47C 31/11 297/180.1 |
| 8,388,056 | B2 | 3/2013 | Smith et al. | |
| 8,864,221 | B1 * | 10/2014 | Delvilla | A47C 7/62 297/180.11 |
| 2004/0155506 | A1 * | 8/2004 | Gentry | A47C 7/748 297/380 |
| 2007/0152479 | A1 * | 7/2007 | Howman | A47C 7/021 297/180.11 |
| 2007/0221658 | A1 * | 9/2007 | Cates | H05B 3/342 219/529 |
| 2010/0025388 | A1 * | 2/2010 | Ono | A47C 7/748 219/217 |
| 2010/0032998 | A1 * | 2/2010 | Eckman | A47C 4/286 297/217.3 |
| 2010/0283295 | A1 * | 11/2010 | Smith | A47C 4/286 297/16.2 |
| 2011/0193372 | A1 | 8/2011 | Pizzuto | |

OTHER PUBLICATIONS

Extended European Search Report for related matter PCT/US2014/058892 dated Nov. 2, 2017, 7 pp.

* cited by examiner

HEATED COVER FOR AN ARTICLE OF FURNITURE

BACKGROUND

The field of this disclosure relates generally to heated covers, and more particularly, to heated covers for articles of furniture.

Known articles of furniture include a variety of different types of articles, including for example chairs. At least some known chairs are collapsible for storage purposes, such as, camping chairs, for example. Such collapsible articles are often used outdoors in the elements and as such, the articles may be exposed to the elements and to a wide range of temperatures.

At least some known collapsible chairs include a foldable chair frame that may be constructed by metal or plastic tubes and a seat fabric. The frame forms a back frame and a seat frame to which a fabric material is coupled thereto. At least some known fabric seats are fabricated from fabric, including twilled nylon and/or other mixing material such as polyurethane.

Because conventional collapsible chairs can be quickly and easily unfolded for use and folded into a compact fold-up structure for transport, a user can easily transport the collapsible chairs to all kinds of outdoor activities, such as camping and sporting events. However, conventional collapsible chairs are not ideal for winter use because the fabric seats are generally thin layers of material such that any portion of the user's body in contact with the fabric may be subjected to lower ambient winter temperatures. In fact, in some such chairs, the bottom surface of the fabric may wick away any heat transferred to the upper surface of the fabric from the body of the seated user.

Accordingly, it would be desirable to produce an insert or cover for an article of furniture that transfers heat to a user and that also retains at least a portion of the heat generated by the user.

BRIEF DESCRIPTION

In one embodiment, heated cover for use with an article of furniture is provided. The heated cover includes a back portion and a seat portion that are fabricated from a conductive material. A plurality of heating pads are positioned to provide heat to the back portion and to the seat portion by converting electrical energy to thermal energy. The heated cover also includes a rechargeable electrical storage device coupled to the plurality of heating pads. The rechargeable electrical storage device is configured to selectively provide electrical energy to the plurality of heating pads.

In another embodiment, a method of assembling a heated cover for use with an article of furniture is provided. The method comprises coupling a plurality of heating pads within a back portion and within a seat portion of the cover. The plurality of heating pads are configured to convert electrical energy to thermal energy, and the back portion and the seat portion are fabricated from a conductive material. The method also includes coupling a rechargeable electrical storage device to the plurality of heating pads, wherein the rechargeable electrical storage device is configured to provide electrical energy to the plurality of heating pads.

In yet another embodiment, a heated cover for use with an article of furniture is provided. The heated cover includes a back portion and a seat portion that are fabricated from a conductive material. A plurality of heating pads are positioned between the exterior top layer and the exterior bottom layer. Each of the plurality of heating pads comprises a heating element configured to convert electrical energy to thermal energy and a padding layer coupled between the heating element and the exterior bottom layer. The heated cover also includes a rechargeable electrical storage device coupled to the plurality of heating pads. The rechargeable electrical storage device is configured selectively to provide electrical energy to the plurality of heating pads.

DETAILED DESCRIPTION

The present disclosure is directed towards a portable, collapsible heated cover for use with a chair. The cover includes a self-contained rechargeable electrical power source, such as a battery pack, for use in selectively operating a plurality of heating pads within the cover. The heating pads are fabricated to be flexible such that the cover can be folded and collapsed into a compact configuration for storage and transport. An external charger may be used to charge the battery pack prior to use so that the portable heated chair cover can be used in locations not accessible by electrical power. The cover also includes a control panel that enables a user to selectively control the temperature of the heating pads according to their comfort. The cover may be assembled from layers of material that are water resistant such that the cover can withstand less than ideal weather conditions and can also retain and transfer heat from the plurality of heating pads to the user's body.

Figure 1:
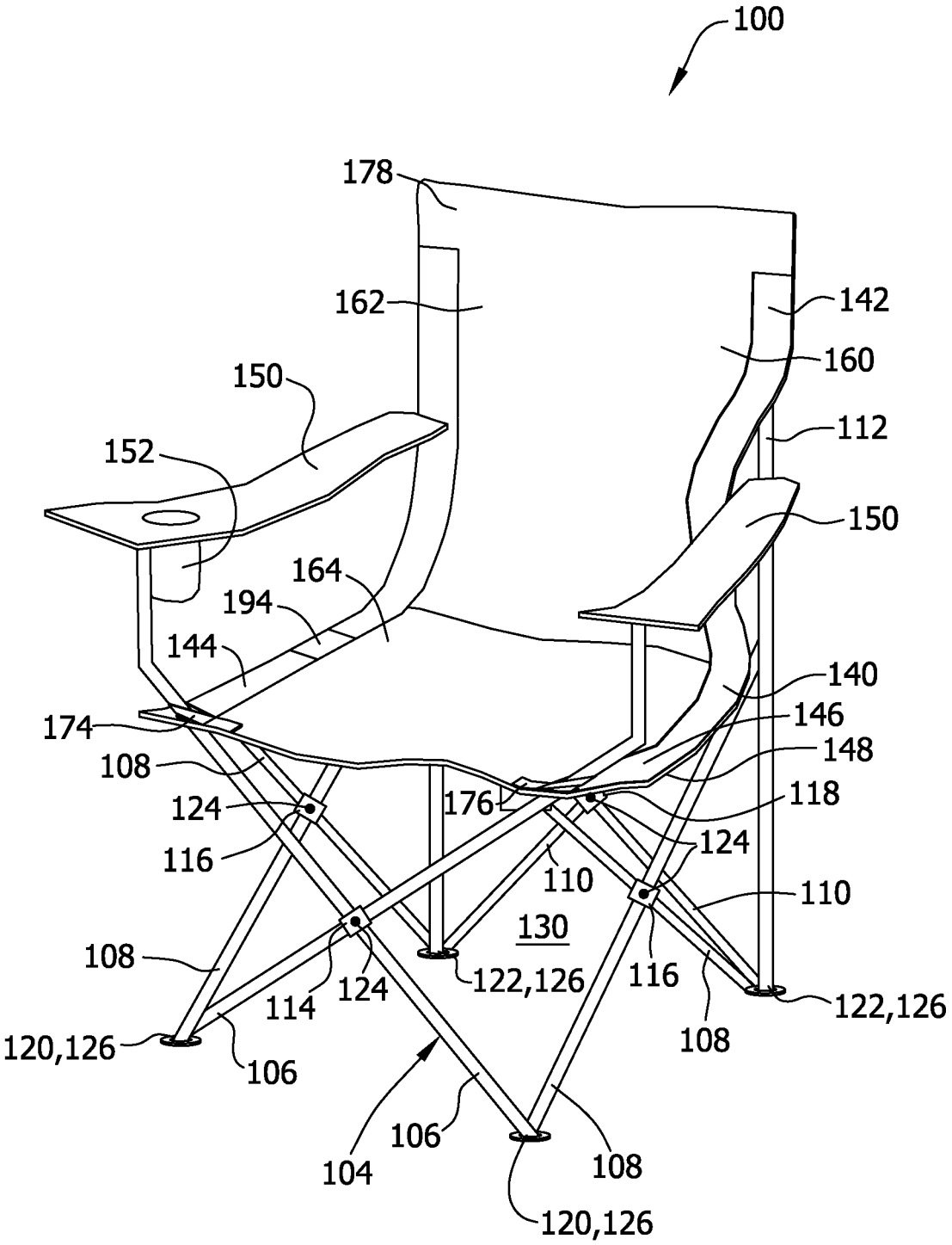
FIG. 1 is a perspective view of an exemplary heated cover that may be used with a collapsible chair.
Figure 2:
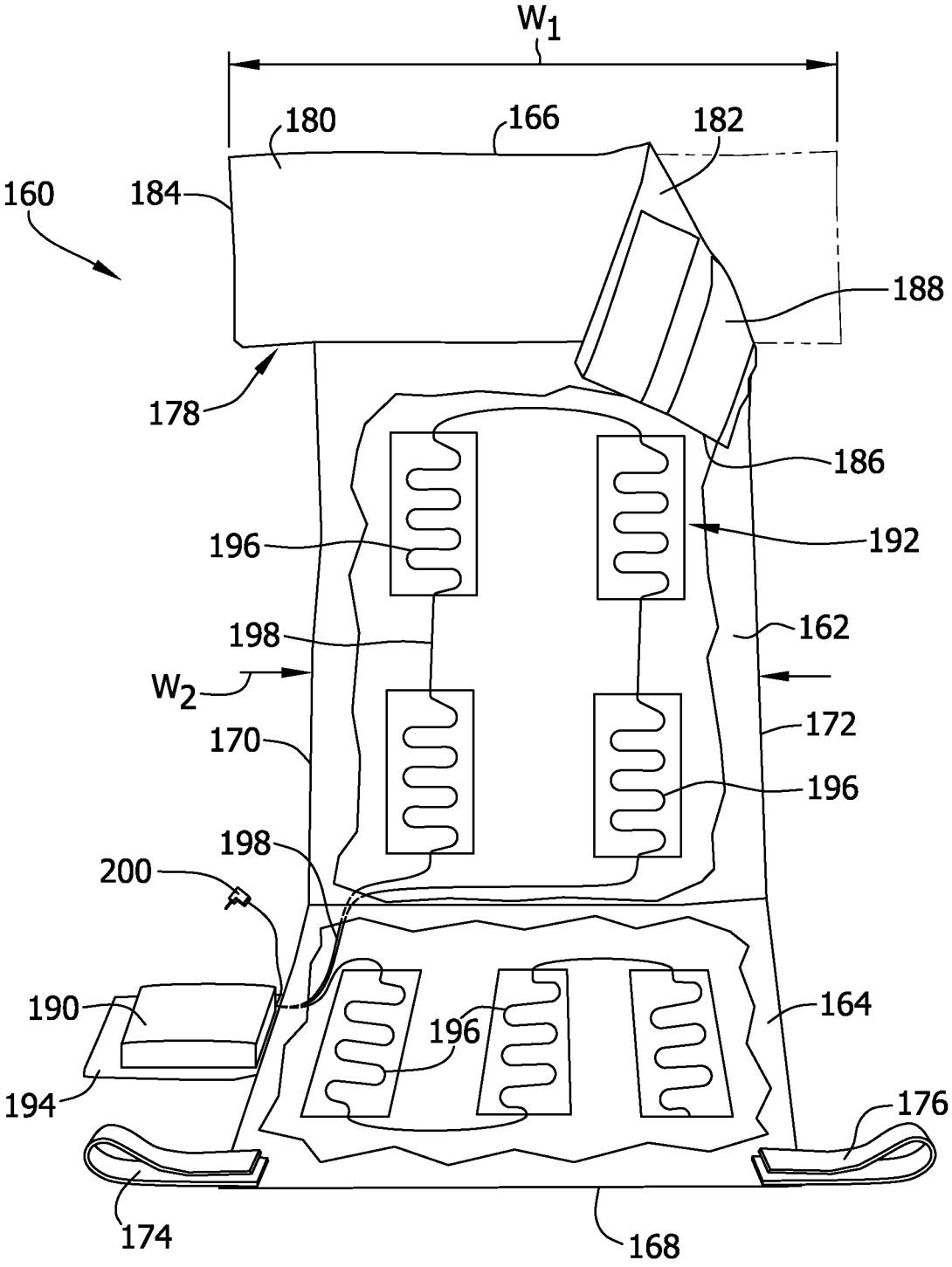
FIG. 2 is a front view of the heated cover shown in FIG. 1 with broken away portions illustrating a plurality of heating pads.

FIG. 1 is a perspective view of an exemplary collapsible camping chair 100 and heated chair cover 160. FIG. 2 is a front view of chair cover 160. The present disclosure is not limited to being used only with a collapsible chair. Rather, the present invention may be used with any type of chair, such as, but not limited to, aluminum folding chairs or any fixed bodied chair. In the exemplary embodiment, chair 100 includes a collapsible frame 104. Frame 104 includes a plurality of front frame members 106, side frame members 108, and rear frame members 110. Frame 104 also includes a plurality of upper members 112 that extend generally vertically upwards from respective rear frame members 110. Front frame members 106 are coupled together at a front pivot assembly 114, and side frame members 108 and rear frame members 110 are coupled together at a respective side pivot assembly 116 and a rear pivot assembly 118. Front frame members 106 and side frame members 108 are also coupled together at front lower pivot assemblies 120, and rear frame members 110 and side frame members 108 are coupled together at rear lower pivot assemblies 122. Pivots 124 couple front pivot assembly 114, side pivot assemblies 116, rear pivot assemblies 118, and the approximate midpoints of members 106, 108, and 110. Front lower pivot assemblies 120 and rear lower pivot assemblies 122 also have feet 126 coupled thereto. Pivot assemblies 114, 116, 118, 120, 122 and pivots 124 couple all the frame members to each other, such that chair 100 is coupled together as a unitary assembly. Frame 104 may be known as an X-frame. Accordingly, frame 104 is movable from an open orientation, wherein a central area 130 is substantially open, to a closed orientation, wherein the size of the central area 130 is substantially reduced.

In the exemplary embodiment, chair 100 also includes a base material 140 coupled thereto. Base material 140 includes a back portion 142 and a seat portion 144. Portions 142 and 144 may be formed from separate pieces of material, or alternatively from a single unitary piece of material. Moreover, portions 142 and 144 are coupled to frame 104 such that a load applied to either portion 142 or 144 (e.g., by an individual sitting on chair 100) is transferred to frame 104. The load may be applied by a user sitting in chair 100 and contacting a top surface 146 of base material 140 that is opposite a bottom surface 148. Base material 140 may be fabricated from any material (e.g., fabric) that has sufficient structural strength to support the weight of an individual seated within chair 100. In the exemplary embodiment, base material 140 is fabricated from nylon and/or any other mixing material such as polyurethane. Additionally, base material 140 may be fabricated from a material that is resistant to moisture and/or sunlight. In the exemplary embodiment, chair 100 includes arm rests 150 that may be formed either integrally with, or separate from, base material 140. Arm rests 150 are suitably coupled to at least a portion of the frame 104 and are sized to permit an individual to rest their arms comfortably thereon when seated in chair 100. In the exemplary embodiment, each arm rest 150 includes at least one cup holder 152. Cup holders 152 may be formed integrally with, or attached to, armrests 150.

In the exemplary embodiment, chair 100 includes a heated cover 160 removably coupled thereto. Cover 160 includes a back portion 162 and a seat portion 164 that are adjacent to base back portion and base seat portions 142 and 144, respectively. Cover 160 extends from a top edge 166 to a bottom edge 168, and from a first side edge 170 to a second side edge 172. A first cover fastener 174 extends from first side edge 170 adjacent to bottom edge 168 and a second cover fastener 176 extends from second side edge adjacent to bottom edge 168. In the exemplary embodiment, fasteners 174 and 176 are hook and loop type fasteners that facilitate coupling cover 160 to a portion of chair 100. More specifically, fasteners 174 and 176 couple cover 160 to front frame members 106 adjacent to base material 140. Alternatively, fasteners 174 and 176 may be any suitable mechanical fastener (e.g., snaps, buttons, zippers, clasps, clips, etc.) that couples cover 160 to any portion of chair 100 and/or base fabric 140 that enables cover 160 and chair 100 to function as described herein.

In the exemplary embodiment, cover back portion 162 includes a pocket 178 that facilitates coupling cover 160 to chair 100. Pocket 178 is defined by top edge 166, opposing front and rear flaps 180 and 182, and by opposing side flaps 184 and 186. In operation, a user separates rear flap 182 from front flap 180 such that flaps 184 and 186 are expanded to form pocket 178. Pocket 178 is sized and oriented to receive at least a portion of back portion 142 and upper members 112 of chair 100 therein to facilitate coupling cover 160 to chair 100. Cover 160 also includes fasteners 188 on rear flap 182 that further facilitate coupling cover 160 to chair 100. Front and rear flaps 180 and 182 have a width $W_1$ that is wider than a width $W_2$ of back and seat portions 162 and 164 of cover 160, such that front and rear flaps 180 and 182 extend a substantially equal distance from both first and second side edges 170 and 172. Width $W_1$ facilitates coupling pocket 178 to chair 100, or to any chair having a width less than width $W_1$.

As described above, cover 160 includes an electrical power source, such as a battery pack 190, which is operable to control activation of a plurality of heating pads 192 within cover 160. Alternatively, battery pack 190 may be coupled to chair 100 such that cover 160 is electrically coupled to chair 100 via battery pack 190. In some embodiments, battery 190 is a rechargeable battery that is capable of repeated charging and discharging cycles. Such batteries are often referred to as "secondary electrochemical cells" and include lithium-ion and nickel-metal hydride batteries, for example. In the exemplary embodiment, battery 190 is a rechargeable lithium-ion battery that is electrically coupled with each heating pad 192. Alternatively, battery 190 may be any device capable of storing electrical energy and providing such energy to heating pads 192 as described herein, such as, without limitation, a lead-acid battery, a nickel-cadmium battery, a nickel-metal hydride battery, an alkaline battery, or a capacitor. Cover 160 includes a battery pouch 194 that is sized to house battery 190 therein. In the exemplary embodiment, pouch 194 is sewn onto seat portion 164 of cover 160 and extends from first side edge 170. Alternatively, battery 190 may be coupled to any portion of cover 160 or, alternatively, battery 190 may not be coupled to cover 160. An external charger may be used to charge battery pack 190 prior to use such that portable heated chair cover 160 can be used in locations not accessible by electrical power. Alternatively, battery pack 190 may be charged using solar power.

In the exemplary embodiment, cover 160 includes a plurality of heating pads 192 that selectively transfer heat from a heating element 196 to a user seated in chair 100. More specifically, either portion 162 and/or 164 includes at least one heating pad 192 integrated therein. As disclosed herein, back portion 162 and seat portion 164 each include a plurality of separate heating pads 192 that are coupled together by wiring 198. Alternatively, portions of heating pads 192 positioned in back portion 162 may be formed continuously with portions of heating pads 192 located within seat portion 164 (i.e., a single heating pad may extend into both portions 162 and 164). Heating pads 192 are "integrated within" cover 160 such that heating pads 192 are either coupled thereto, or are formed integrally with either portion 162 and/or 164, and as such are not readily removed from cover 160. For example, heating pads 192 may be encased between two separate layers (not shown in FIG. 1 or 2) that together form cover 160.

Each heating pad 192 includes an electrical resistance type heating element 196 positioned thereon that receives electricity via wiring 198. Alternatively, heating elements 196 may be any type of electrically-powered heating element that enables cover 160 to function as described therein. In the exemplary embodiment, heating elements 196 generate heat by converting electrical energy from battery pack 190 into heat energy by passing current through one or more conductors that restrict the flow of electricity therethrough to generate heat. This restriction results in the generation of heat. An amount of heat energy generated by heating elements 196 is dependent on a variety of factors, such as, but not limited to, the type of material from which heating elements 196 are fabricated and/or the voltage and amount of electricity flowing therethrough (i.e., the current). Each heating element 196 is arranged in a serpentine or generally looped orientation on a respective heating pad 192 and includes wiring 198 that extends from seat portion 164.

Wiring 198 electrically couples heating pads 192 together and terminates at an electrical connector 200 wherein a source of electrical energy, such as battery pack 190, may be electrically connected to wiring 198.

Figure 3:
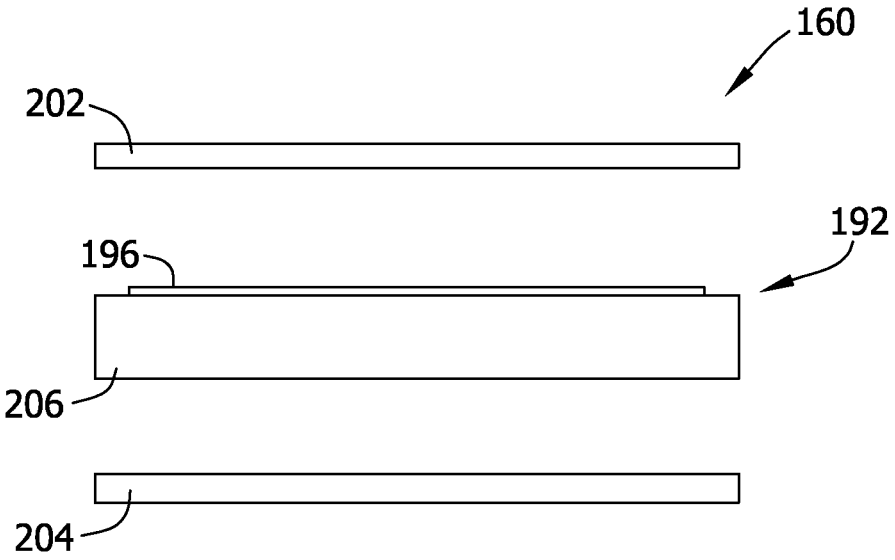
FIG. 3 is a cross-sectional view of a portion of the heated cover shown in FIGS. 1 and 2.

FIG. 3 is a cross-sectional view of a portion of heated cover 160. In the exemplary embodiment, cover 160 includes an exterior top layer 202 and an exterior bottom layer 204 that each extend over back and seat portions 162 and 164 of cover 160. Exterior top and bottom layers 202 and 204 are configured to enclose the plurality of heating pads 192 therebetween. One example of a material suitable for use as layers 202 and 204 is FabRoc produced by EXO2 of Lanarkshire, United Kingdom. Materials such as FabRoc are electrically and heat conductive fabrics with a specific structure that generates heat when electrical current is passed therethrough. In another embodiment, layers 202 and 204 are manufactured from a material, such as but not limited to, neoprene such that cover 160 (shown in FIG. 1) is at least partially waterproof to resist damage due to being outdoors or from washing cover 160 and also retain and transfer heat from plurality of heating pads 192 to the user's body. In the exemplary embodiment, exterior bottom layer 204 is configured to contact top surface 146 (shown in FIG. 1) of base material 140 and exterior top layer 202 is configured to contact at least a portion of the user's body such that heat from the plurality of heating pads 192 is transferred through top layer 202 to the user.

In the exemplary embodiment, cover 160 includes an integrally formed windscreen (not shown) to restrict the flow of air and/or heat through base material 140 of chair 100. Alternatively, the windscreen may be coupled to cover 160 and/or to chair 100. In such an embodiment, the windscreen is positioned beneath and adjacent to base material 140 and opposite cover 160 such that the windscreen is not between a user's body and base material 140 and/or cover 160 when the user is seated in chair 100. The windscreen is secured to frame 104 of chair 100 by a plurality of fasteners (not shown). In the exemplary embodiment, the fasteners are disposed generally at the corners of the windscreen, although in other embodiments the fasteners may be positioned differently. The fasteners in the exemplary embodiment are hook-and-loop fasteners, although in other embodiments the fasteners may be any suitable mechanical fasteners (e.g., snaps, buttons, zippers, clasps, etc.). Moreover, the fasteners can include a pocket or other structure formed in the windscreen for fitment over a portion of cover 160 (e.g., back portion 162 and/or front portion 164) and/or base material 140 (e.g., back portion 142 and/or front portion 144).

The windscreen is constructed from a material that restricts or blocks the flow of air and/or heat therethrough, such as polyurethane or similar materials. Moreover, the windscreen may be formed from a fabric-like material that includes both natural and synthetic materials. The windscreen can also be a multi-layer structure that includes a layer of insulating materials disposed between two other layers. Furthermore, heat generated by heating pads 192 is restricted or prevented from travelling through base material 140 and/or exterior top and bottom layers 202 and 204 in a direction away from the user. The windscreen thus reduces the amount of heat required to be generated by heating pads 192 in order to warm a user seated in chair 100. As such, heating pads 192 require less electrical energy and the amount of time battery 190 is able to power heating pads 192 is increased. The windscreen thus significantly increases the efficiency of cover 160 and the comfort of a use seated in chair 100 having cover 160.

While the windscreen is described as being used in conjunction with chair 100 having cover 160 coupled thereto, the windscreens may be used with any suitable chair, including those that do not have heated cover 160. Moreover, heating pads the same as or similar to those described herein may be integrated within or otherwise attached to the windscreen. A windscreen having heating pads 192 described herein can be used with chair 100, or such the windscreen can be used with chairs that do not have cover 160 coupled thereto.

In the exemplary embodiment, each heating pad 192 includes heating element 196 coupled to at least one padding layer 206. In another embodiment, heating element 196 is formed integrally with the fabric or other material which forms layers 202 and 204. Padding layer 206 is configured to provide an extra layer of comfort for the user in addition to exterior layers 202 and 204 which also serve as additional padding. In the exemplary embodiment, padding layer 206 is fabricated from a resilient foam material. Alternatively, padding layer 206 may be fabricated from any material, such as a gel material, that facilitate operation of cover 160 as described herein. In the exemplary embodiment, heating element 196 is coupled to padding layer 206 using an adhesive. Alternatively, heating element 196 may be coupled to padding layer 206 by any means, such as by stitching heating element 196 to padding layer 206, that facilitates operation of cover 160 as described herein. Cover 160 and its components, exterior layers 202 and 204, heating element 196, and padding layer 206 are fabricated from flexible materials to facilitate folding and collapsing of cover 160 into a compact configuration for storage and transport.

In operation, a user couples cover 160 to chair 100 (shown in FIG. 1) using at least one of fasteners 174, 176, and 188 (shown in FIGS. 1 and 2) and/or by inserting a portion chair 100 into pocket 178 (shown in FIG. 2) such that exterior bottom layer 204 of cover 160 is adjacent top surface 146 of base material 140. The user then selectively operates battery pack 190 (shown in FIG. 2) to transfer electrical energy through wiring 198 (shown in FIG. 2) to the plurality of heating pads 192. More specifically, battery pack 190 transfers electrical energy to heating elements 196, which convert the electrical energy into heat energy. The heat energy generated by heating elements 196 is transferred through top exterior layer 202 of cover 160 to at least a portion of the user's body to provide warmth to the user.

Figure 4:
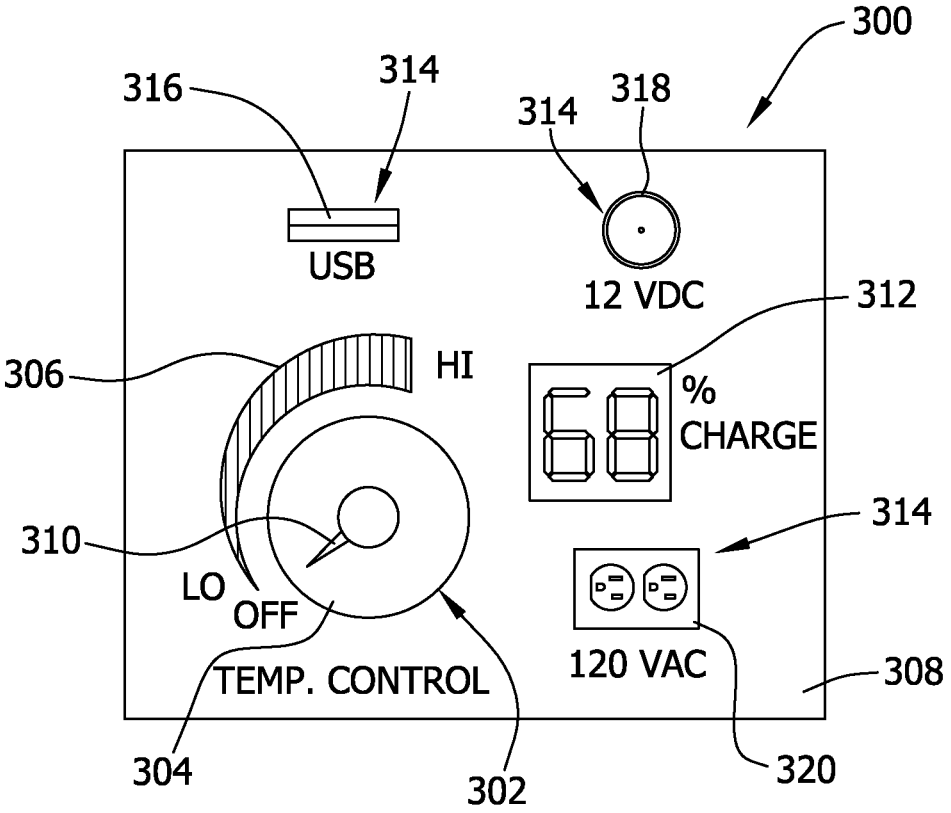
FIG. 4 is a side view of an exemplary control panel that may be used with the exemplary heated cover shown in FIG. 1.

FIG. 4 is a side view of an exemplary control panel 300 that may be used with cover 160. In the exemplary embodiment, control panel 300 is electrically coupled to heating element 196 and battery pack 190. More specifically, control panel 300 may either be integrated with battery pack 190 or may be a separate component that is coupled to battery pack 190. Control panel 300 functions to control an amount of electrical energy supplied to the plurality of heating pads 192, and more specifically, heating elements 196, from battery 190. In alternative embodiments, control panel 300 and battery 190 may be located separately and detached from cover 160. In this alternative embodiment, a single control panel 300 and battery 190 may be used to provide electrical energy to multiple covers 160. Control panel 300 and battery 190 may be co-located together, and multiple covers 160 may be electrically coupled thereto with electrical extension cords or other electrical connectors. Moreover, multiple batteries 190 may be used in conjunction with control panel 300 to power either one or more covers 160.

In the exemplary embodiment, control panel 300 includes a temperature control 302 that is used to regulate an amount of heat generated by the plurality of heating pads 192.

Temperature control 302 includes a knob 304 that is rotatably coupled to an electrical control device (not shown). A scale 306 is printed or otherwise affixed to a surface 308 of control panel 300. Scale 306 can indicate a range of temperatures or desired comfort levels. Knob 304 is thus rotated by an individual until a pointer 310 or other indicia thereon is aligned with a desired point on scale 306 corresponding to either a specific temperature or a general comfort level setting (e.g., hot, warm, or off).

The electrical control device used with temperature control 302 varies an amount of current or voltage supplied to each heating element 196 in one embodiment. Alternatively, electrical control device is a thermostat which selectively controls an amount of electrical energy to each heating element 196 based on a measured temperature and a set point. The thermostat thus monitors the temperature of a point on cover 160 adjacent to heating pads 192 with a thermocouple or other suitable device.

A charge indicator 312 is also provided in control panel 300 in the form of a numeric display. Charge indicator 312 presents a visual indication of an amount of charge or "useful life" remaining in battery 190. This indication can be expressed as a percentage of the total charge which battery 190 is capable of storing. In the exemplary embodiment, the indication is presented on a digital display.

In the exemplary embodiment, control panel 300 also includes a plurality of auxiliary electrical connectors 314. Connectors 314 enable electrically-powered accessories to be coupled to control panel 300, and in turn to battery 190. Accordingly, connectors 314 enable electrical energy to be transferred to the accessories from battery 190, such that the accessories may be electrically charged.

Varieties of different types of electrical connectors 314 are included in the exemplary embodiment. For example, electrical connector 314 may be, but are not limited to, a Universal Serial Bus (USB) connector 316, a 12 volt direct current accessory plug 318 (i.e., a cigarette lighter plug), and/or a 120 volt alternating current electrical socket 320. Accordingly, electrical energy may be supplied from battery 190 to electrically powered accessories (e.g., a wireless phone charger, a digital media player, or a computing device) via control panel 300 through connectors 314.

In another embodiment, at least one connector 314 is an electrical connector that enables an electrical input source (i.e., an extension cord) to be electrically coupled to control panel 300 and to supply battery 190 with electrical energy. Charging battery 190 in such a manner is useful when access to other sources of electrical energy is available.

The embodiments disclosed herein provide for a cover for an article of furniture, wherein the cover includes electrical heating elements. The cover also includes a plurality of heating pads that each include a heating element coupled to a padding layer. Electrical energy is supplied to each of the heating elements from a rechargeable electrical storage device. Accordingly, the heated cover of furniture may be used in environments without ready access to other sources of electrical energy, such as in remote areas. Moreover, the heated cover may be used with an article of furniture that is susceptible to colder temperatures and that does not retain the body heat generated by a user. Furthermore, the components of the heated cover, and more specifically the heating elements, the padding layer, and exterior top and bottom layers, are flexible, such that the heated cover is foldable into a collapsed configuration when in not in use and is expandable to an open configuration when in use. Moreover, the self-contained power source may be used to provide electrical energy to other devices.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A heated cover for use with an article of furniture, said heated cover comprising:

a back portion of said cover, said back portion comprising a first plurality of heating pads physically spaced a distance apart and electrically coupled together to provide heat to said back portion by converting electrical energy to thermal energy, said back portion comprising a first plurality of outer edges bordering said back portion;

a seat portion of said cover, said seat portion comprising a second plurality of heating pads physically spaced a distance apart and electrically coupled together to provide heat to said seat portion by converting electrical energy to thermal energy, said first plurality of heating pads electrically coupled to said second plurality of heating pads, wherein said back portion and said seat portion are fabricated from a conductive material, wherein said back portion and said seat portion are entirely flexible and do not comprise a structural frame, said seat portion comprising a second plurality of outer edges bordering said seat portion, wherein the back portion and seat portion are configured to be draped over a chair, wherein said back portion and said seat portion are continuous between respective first and second pluralities of outer edges such that said back portion and said seat portion do not include openings;

a pouch of said cover, said pouch comprising a plurality of pouch edges, said pouch coupled to one of said plurality of outer edges of said seat portion along only a single one of said plurality of pouch edges such that said pouch extends outwardly from said seat portion;

a rechargeable electrical storage device coupled to said plurality of heating pads, said rechargeable electrical storage device configured to selectively provide electrical energy to said plurality of heating pads, wherein said rechargeable electrical storage device is removably contained within said pouch, said pouch being suspended from said seat portion such that said rechargeable electrical storage device is suspended from said seat portion when said rechargeable electrical storage device is contained within said pouch such that said pouch does not support a user seated on the article of furniture when said heated cover is coupled to the article of furniture; and a control panel coupled to said rechargeable electrical storage device and to said plurality of heating pads, wherein said control panel comprises a temperature control configured to regulate an amount of heat generated by said plurality of heating pads, wherein said control panel further comprises a charge indicator to provide a visual indication of an amount of charge remaining in said rechargeable electrical storage device.

2. The heated cover in accordance with claim 1 further comprising a pocket configured to facilitate coupling the heated cover to the article of furniture, said pocket defined on at least one of said back portion and said seat portion by a pair of opposing side flaps, a front flap, and a rear flap.

3. The heated cover in accordance with claim 2, wherein said front and rear flaps each have a width that is wider than a width of each of said back portion and said seat portion.

4. The heated cover in accordance with claim 1, wherein each of said plurality of heating pads comprises a heating element configured to:

convert electrical energy from said rechargeable electrical storage device to thermal energy; and provide thermal energy to a user.

5. The heated cover in accordance with claim 4, wherein each of said heating elements is coupled to a padding layer comprising a resilient foam material.

6. The heated cover in accordance with claim 1 further comprising an exterior top layer and an exterior bottom layer that are coupled together to house said plurality of heating pads therebetween, wherein said exterior top layer is configured to transfer thermal energy from said plurality of heating pads to a user.

7. The heated cover in accordance with claim 1 further comprising a pair of opposing fasteners coupled to said seat portion for coupling said heated cover to the article of furniture.

8. A method of assembling a heated cover for use with an article of furniture, said method comprising;

coupling a first plurality of heating pads within a back portion of the cover, wherein the first plurality of heating pads are physically spaced a distance apart and electrically coupled together to provide heat to the back portion by converting electrical energy to thermal energy, wherein the back portion and seat portion are configured to be draped over a chair, the back portion including a first plurality of outer edges bordering the back portion;

coupling a second plurality of heating pads within a seat portion of the cover, wherein the second plurality of heating pads are physically spaced a distance apart and electrically coupled together to provide heat to the seat portion by converting electrical energy to thermal energy, wherein the back portion and the seat portion are fabricated from an electrically conductive fabric material, and wherein the back portion and the seat portion are entirely flexible and do not comprise a structural frame, the seat portion including a second plurality of outer edges bordering said seat portion, wherein the back portion and the seat portion are continuous between respective first and second pluralities of outer edges such that the back portion and the seat portion do not include openings;

coupling one of a plurality of pouch edges of a pouch to only a single one of the plurality of outer edges of the seat portion such that the pouch extends outwardly from the seat portion;

coupling a rechargeable electrical storage device to the plurality of heating pads, wherein the rechargeable electrical storage device is configured to provide electrical energy to the plurality of heating pads, and wherein the rechargeable electrical storage device is removably contained within the pouch, the pouch being suspended from the seat portion such that the rechargeable electrical storage device is suspended from the seat portion when the rechargeable electrical storage device is contained within the pouch such that the pouch does not support a user seated on the article of furniture when the heated cover is coupled to the article of furniture; and coupling a control panel to the rechargeable electrical storage device and to the plurality of heating pads, wherein the control panel includes a temperature control configured to regulate an amount of heat generated by the plurality of heating pads, wherein the control panel further comprises a charge indicator to provide a visual indication of an amount of charge remaining in the rechargeable electrical storage device.

9. The method in accordance with claim 8, wherein coupling a plurality of heating pads within a back portion and within a seat portion of the cover further comprises coupling a plurality of heating pads that each include a heating element coupled to a padding layer that is comprised from a resilient foam material.

10. The method in accordance with claim 8 further comprising coupling the plurality of heating pads between an exterior top layer and an exterior bottom layer, wherein the exterior top layer is configured to transfer thermal energy from the plurality of heating pads to a user.

11. The method in accordance with claim 8 further comprising coupling a pair of opposing fasteners to a seat portion of the heated cover, wherein the pair of opposing fasteners are configured to couple the heated cover to the article of furniture.

12. A heated cover for use with an article of furniture, said heated cover comprising:

an exterior top layer of said cover, said exterior top layer comprising a plurality of top outer edges, wherein said exterior top layer is continuous between said plurality of top outer edges such that said exterior top layer does not include openings;

an exterior bottom layer of said cover, said exterior bottom layer comprising a plurality of bottom outer edges, wherein said exterior bottom layer is continuous between said plurality of bottom outer edges such that said exterior bottom layer is does not include openings, wherein said plurality of top outer edges and said plurality of bottom outer edges combine to form a plurality of outer edges of said heated cover, wherein said exterior top layer and said exterior bottom layer are fabricated from a conductive material and are entirely flexible, wherein said heated cover does not include a structural frame between said exterior top layer and said exterior bottom layer, wherein the exterior top layer and exterior bottom layer are configured to be draped over a chair, wherein the exterior top layer and exterior bottom layer;

a pouch of said cover, said pouch comprising a plurality of pouch edges, said pouch coupled to layer one of said plurality of outer edges of along only a single one of said plurality of pouch edges such that said pouch extends outwardly from said one outer edge;

a plurality of heating pads of said cover, said plurality of heating pads positioned between said exterior top layer and said exterior bottom layer, wherein each of said plurality of heating pads comprises:

a heating element configured to convert electrical energy to thermal energy; and a padding layer coupled between said heating element and said exterior bottom layer, wherein said exterior top layer, said exterior bottom layer, and said padding layer are substantially parallel to each other and comprise the only three layers of said heated cover; and a rechargeable electrical storage device coupled to said plurality of heating pads, said rechargeable electrical storage device configured to selectively provide electrical energy to said plurality of heating pads, wherein said rechargeable electrical storage device is removably contained within said pouch, said pouch being suspended from said exterior bottom layer such that said rechargeable electrical storage device is suspended from said exterior bottom layer when said rechargeable electrical storage device is contained within said pouch such that said pouch does not support a user seated on the article of furniture when said heated cover is coupled to the article of furniture; and a control panel coupled to said rechargeable electrical storage device and to said plurality of heating pads, wherein said control panel comprises a temperature control configured to regulate an amount of heat generated by said plurality of heating pads, wherein said control panel further comprises a charge indicator to provide a visual indication an amount of charge remaining in said rechargeable electrical storage device.

13. The heated cover in accordance with claim 12, wherein said padding layer is comprised from a resilient foam material.

14. The heated cover in accordance with claim 12, wherein said exterior top layer is configured to transfer thermal energy from said heating elements to a user.

15. The heated cover in accordance with claim 12, wherein said exterior top and exterior bottom layers and said plurality of heating pads are comprised of flexible materials that facilitate collapsing the cover into a compact configuration for storage and transport.

16. The heated cover in accordance with claim 12, wherein said control panel controls the flow of electrical energy supplied by said rechargeable electrical storage device to said plurality of heating pads.

17. The heated cover in accordance with claim 5, wherein said padding layer comprises a first surface and an opposing second surface, and wherein each of said heating elements is coupled to one of said first surface and said second surface.

18. The heated cover in accordance with claim 12, wherein said padding layer is coupled to said exterior bottom layer such that said exterior bottom layer and said padding layer are in continuous contact with each other.

19. The heated cover in accordance with claim 1, wherein said seat portion and said back portion are configured to conform to a shape of the article of furniture.

* * * * *